US006302127B1

(12) United States Patent
Gayton

(10) Patent No.: US 6,302,127 B1
(45) Date of Patent: Oct. 16, 2001

(54) PORTABLE STRUCTURE

(76) Inventor: Charles F. Gayton, 445 Somerset Pl., La Canada, CA (US) 91011

( * ) Notice: Subject to any disclaimer, the term of this patent is extended or adjusted under 35 U.S.C. 154(b) by 0 days.

(21) Appl. No.: 09/428,388

(22) Filed: Oct. 28, 1999

(51) Int. Cl.[7] ..... E04H 15/44
(52) U.S. Cl. ..... 135/124; 135/126; 135/117
(58) Field of Search ..... 135/124–26

(56) References Cited

U.S. PATENT DOCUMENTS

| | | | |
|---|---|---|---|
| 3,990,463 | 11/1976 | Norman . | |
| 4,815,784 | 3/1989 | Zheng . | |
| 4,825,892 | 5/1989 | Norman . | |
| 5,038,812 | 8/1991 | Norman . | |
| 5,301,705 | 4/1994 | Zheng . | |
| 5,452,934 | 9/1995 | Zheng . | |
| 5,467,794 | 11/1995 | Zheng . | |
| 5,560,385 | 10/1996 | Zhen . | |
| 5,579,799 | 12/1996 | Zheng . | |
| 5,618,246 | 4/1997 | Zheng . | |
| 5,664,596 | 9/1997 | Zheng . | |
| 5,722,446 | 3/1998 | Zheng . | |
| 5,778,915 | 7/1998 | Zheng . | |
| 5,816,278 * | 10/1998 | Kim | 135/126 |
| 6,092,544 * | 10/1998 | Zheng | 135/125 |

* cited by examiner

*Primary Examiner*—Beth A. Stephan
(74) *Attorney, Agent, or Firm*—Lyon & Lyon LLP

(57) ABSTRACT

A structure includes a frame formed of a flexible endless band in an arched figure eight. The band includes roof sections extending from the cross-over point, wall sections extending from the roof sections and foot sections each extending between two of the wall sections. The band has a permanent deformation which may be an abrupt angle at each position between the roof sections and the wall sections. Sheet material extends across the loops of the figure eight frame, between adjacent roof sections to form a pitched roof and between at least three adjacent wall sections. A retainer at the cross-over point in the figure eight is attached to the endless band at two opposed positions and has a fixed position retaining the band at the two opposed positions fixed together. It may have a release position retaining the band at the two opposed positions rotatable relative to one another. The resilient endless band is collapsible into a configuration with six overlying coils. A rigid brace extends from one portion of the band forming one loop to another portion of the band forming the other loop.

35 Claims, 10 Drawing Sheets

PORTABLE STRUCTURE

BACKGROUND OF THE INVENTION

The field of the present invention is structures made of simple frame elements and flexible sheet material.

Structures which are composed of one or more continuous flexible figure eight loops with fabric extending between sections of the loops to define a partial or full enclosure have been developed which can be quickly erected or collapsed. Such devices are illustrated in U.S. Pat. No. 3,900,463; U.S. Pat. No. 4,825,892; and U.S. Pat. No. 5,038,812, the disclosures of each of which are incorporated herein by reference.

The simplest of the structures disclosed in the aforementioned patents is formed by a single figure eight frame. Structures using this frame construction have proven to be stable in the erected position. Even so, they remain quite flexible in keeping with their facile erectible and collapsible nature.

Other devices have used flexible figure eight loops. Collapsible automobile window shades employ a loop contained within a bag to create a planar shade. The loop, when expanded, stretches the bag to fill the window. To maintain the figure eight form, the portions of the loop at the cross over point are pinned together. As the natural tendency of the loop in this application is to be open, the pin allows free relative rotation of the loop portions for facile deployment. The pin is used to keeps the loop portions together at the cross over. This insures that the shade remains substantially planar and in position.

Sheet material, including netting, can be arranged over a portion or all of the frame to define rounded tent-like structures, supporting structures for targets and the like, or containers or other devices utilizing the space-defining frame and support characteristics. The sheet material has included formed pockets and tubes to retain the frame member or members. The shapes of the structures have been principally defined by the operative frame elements arranged in the substantially continuous complex curved structure defined by the arched figure eight as constrained by the formed sheet material.

The sheet material has been used to define tighter curves, flat portions, and the like by constraining the frame element or elements. The frame elements have been left without permanent deformations such as tight bends and abrupt angles. This use of unbent frame elements has been encouraged by the spring steel makeup of the elements and by the desire to achieve a compact coiled device in the collapsed configuration. Reliance for shape has also been placed on the springy nature of the frame. Constraining elements and retainers have not been employed beyond the tensioning of the sheet material itself as interfering with the simplicity of the structure.

SUMMARY OF THE INVENTION

The present invention is directed to a structure including a frame formed of a resilient endless strap in the shape of an arched figure eight with sheet material extending over at least a portion of the loops of the figure eight.

In a first separate aspect of the present invention, a retainer is employed at the cross-over point on the figure eight of the frame. The retainer provides the capacity to fix the two opposed portions of the loop at the cross-over point in an open position. In the open position, the two opposed portions are retained in fixed relationship to decrease flexibility of the structure and increase stability. The retainer may be any of a number of mechanisms supplying a variety of advantages and functions. Bolts and wing nuts, clamps, overcenter mechanisms and friction pins and rivets are contemplated as the retaining system.

In a second separate aspect of the present invention, the retainer of the first separate aspect has the capability of providing a fixed position and a release position. The fixed position retains the two opposed positions of the frame at the cross-over point in fixed relationship to decrease flexibility of the structure and increase stability. The release position allows the structure to be collapsed.

In a third separate aspect of the present invention, the frame achieves amended structural shapes through the presence of permanent deformations such as tight bends and abrupt angles at strategic positions in the figure eight. A roof structure and wall structures can be more distinctly defined by such permanent bends and abrupt angles between roof sections and wall sections defined by the figure eight. Foot sections and wall sections can also be more distinctly defined by such permanent bends and abrupt angles. Other shapes are possible such as cubes and recognizable objects based on the permanent deformation of the frame.

In a fourth separate aspect of the present invention, the frame may include a brace extending between sections of the frame for added dimensional stability. Such braces contemplate a bar, simple, telescoping or collapsible, a frame such as of another flexible band and the like.

In a fifth separate aspect of the present invention, the frame achieves a cube or other polygonal shape through the presence of two arched figure eight bands opposing one another. Each figure eight may include permanent deformations in strategic positions. A roof structure and wall structures can be more distinctly defined by permanently defined abrupt angles between roof sections and wall sections.

In a sixth separate aspect of the present invention, the frame achieves a cube shape through the presence of a single arched figure eight band where the band is arched at abrupt angles at all corners. A floor piece is attached to the two structures, by a hinge on one side and by hook and loop material, snaps or other fasteners on the other, such that the floor piece or pieces, approximates the side and can be collapsed first for ease in disassembling the structure.

In a seventh separate aspect of the present invention, the frame is irregularly shaped such as in the likeness of a car, in that the figure eight band is positioned so that there is an extended foot section and the loops formed by the figure eight are asymmetrical. The figure eight is held in place at the cross-over point, which can be at a lower height than the apex.

In a eighth separate aspect of the present invention, any of the foregoing aspects are contemplated to be used in combination.

Accordingly, it is a principal object of the present invention to provide an improved structure defined by an arched figure eight and sheet material extending across at least a portion of the loops of the figure eight. Other and further objects and advantages will appear hereinafter.

DETAILED DESCRIPTION OF THE PREFERRED EMBODIMENT

Figure 1:
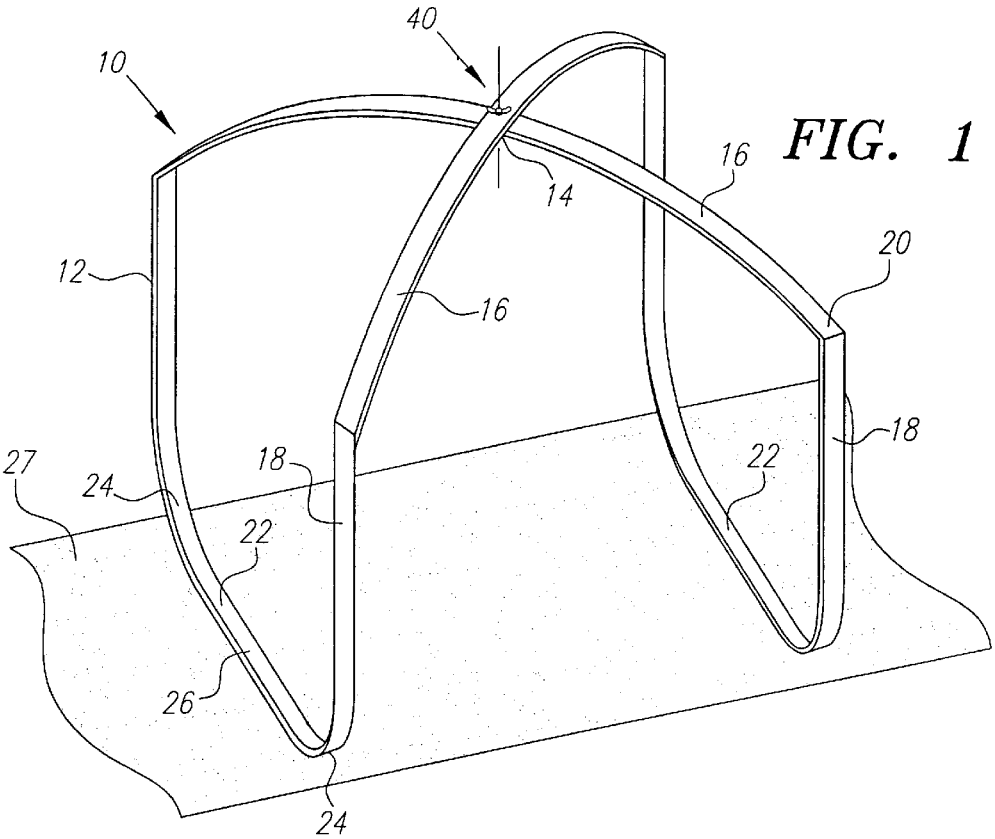
FIG. 1 is a perspective view of a frame defined by a resilient endless member in the shape of an arched figure eight with parallel side portions.
Figure 2:
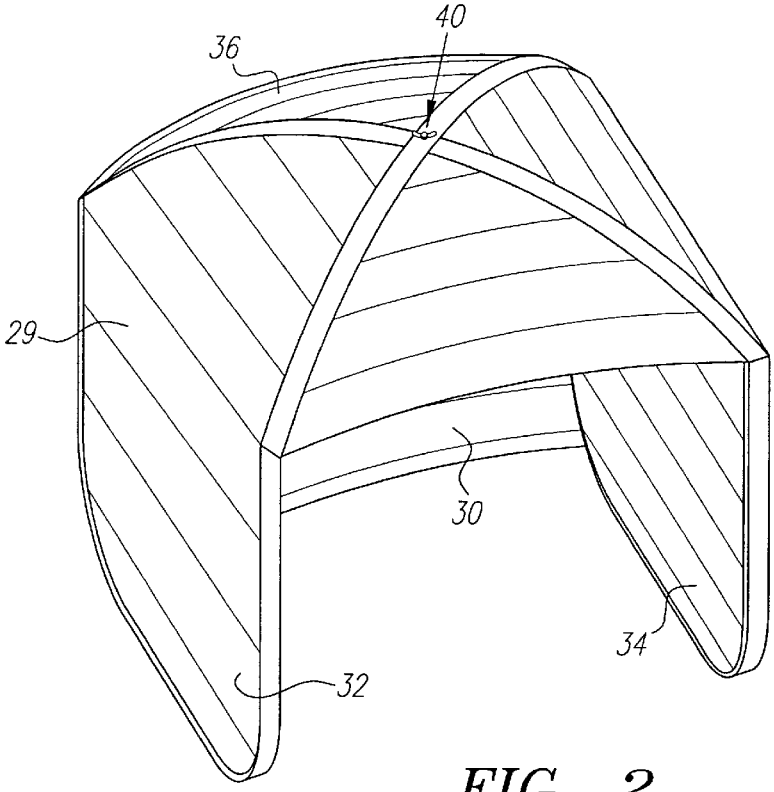
FIG. 2 is a perspective view of a structure with the frame of FIG. 1 and sheet material thereon.

Turning in detail to the Figures, the frame of a structure is illustrated in FIG. 1 while a complete assembly of one possible structure is illustrated in FIG. 2. In FIG. 1, the frame, generally designated 10, is shown to be a resilient endless band arranged in the shape of an arched figure eight. A spring steel strap 12 is used for this structure with appropriate permanently bent and angled sections to accomplish a desired result. To naturally achieve the figure eight configuration, the strap 12 is twisted 360° before attaching the two ends in a connector to form the endless member. As has been recognized previously, such a configuration provides the capability for collapsing the frame structure into a series of overlying coils for storage and convenient transportation.

For convenience of discussion, various parts of this continuous member are separately named. Two opposed positions on the frame 10 are immediately adjacent one another at the cross-over point 14. Four upright sections extend from the cross-over point 14 to the base portion of the frame. These upright sections may each be characterized as including a roof section 16 and a wall section 18. Four roof sections 16 extend from the cross-over point 14 in the embodiment of FIG. 1. These are shown to be arched such that a structure for a pitched roof is provided. The four roof sections extend a first length which may be determined based on the intended shape of the resulting structure.

Figure 11:
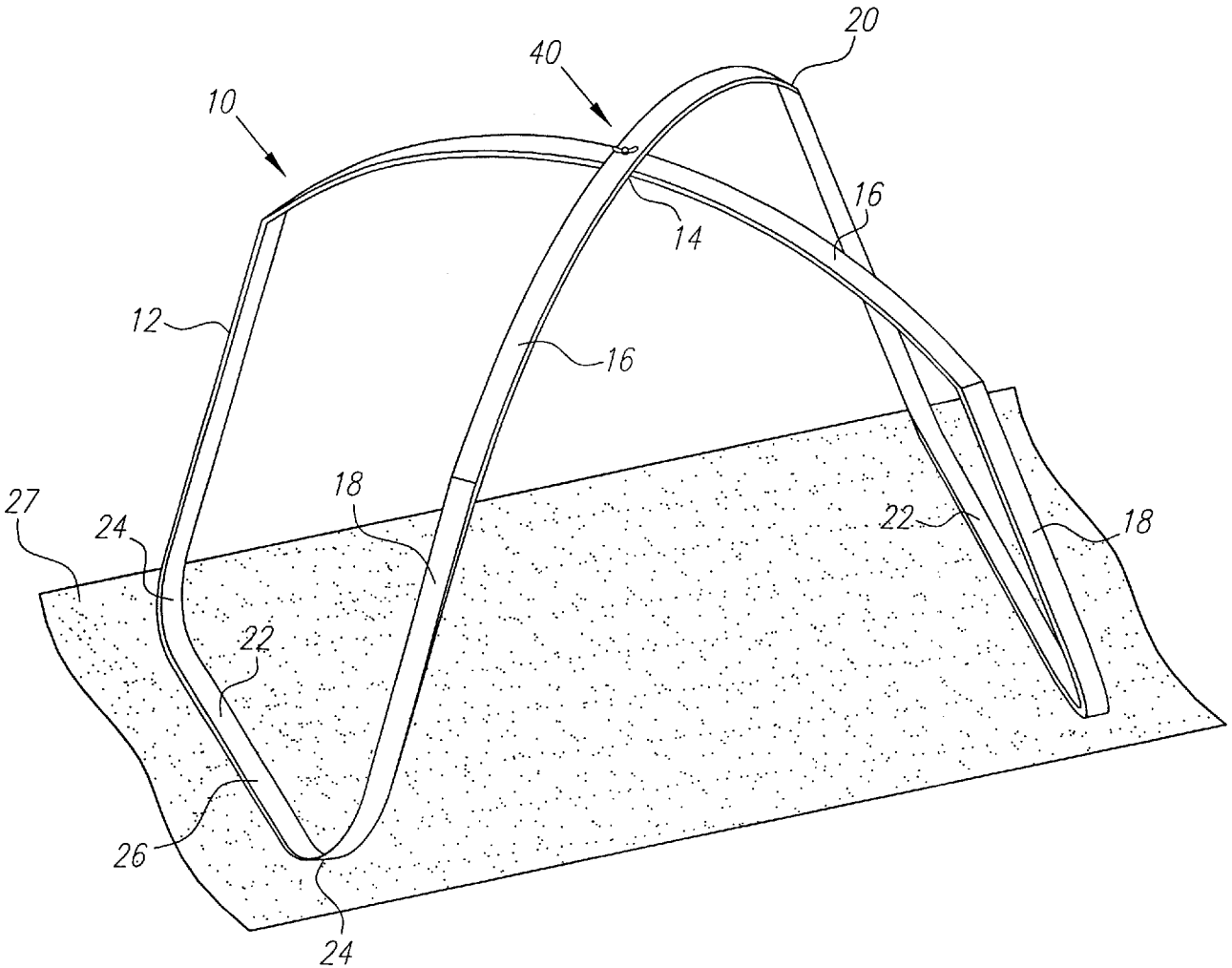
FIG. 11 is a perspective view of a frame defined by a resilient endless member in the shape of an arched figure eight with nonparallel side portions.

Four wall sections 18 extend downwardly from the ends of the four roof sections 16. The wall sections 18 may be substantially parallel, e.g., FIG. 1, or angled outwardly, e.g., FIG. 11, depending upon the desired configuration. Unless otherwise specifically indicated, both parallel and nonparallel configurations are contemplated. The length of these wall sections 18 helps determine the ultimate structure height. Between the four roof sections and the four wall sections, respectively, abrupt angles 20 change the direction from a roof pitch to a wall configuration. These abrupt angles 20 are achieved by permanent deformation of the spring steel strap 12 at the appropriate locations.

Two foot sections 22 extend from pairs of the wall sections 18. These foot sections 22 complete the closure of the loop portions of the figure eight configuration. The foot portions may be understood as including an arch transition 24 at either end of an elongate section 26. The arch transitions 24 provide an appropriate transition from the wall sections to the effective foot of the structure. The curvature also assists in the capability for the device to collapse to a coiled structure. The elongate section 26 may be sufficiently flat, weak or even slightly inwardly arched such that it does not assume a convex curvature which would act as a rocker to destabilize the overall structure when resting on a support surface 27. Rather, the elongate section 26 is formed in such a way that the arch transitions 24 bear the substantial weight of the frame. By placing the supports at the outer corners, stability is increased. The arch transitions 24 are preferably created by a permanent bending of the spring steel strap 12 rather than through restraint from the sheet material, although the latter may be employed.

Figure 5:
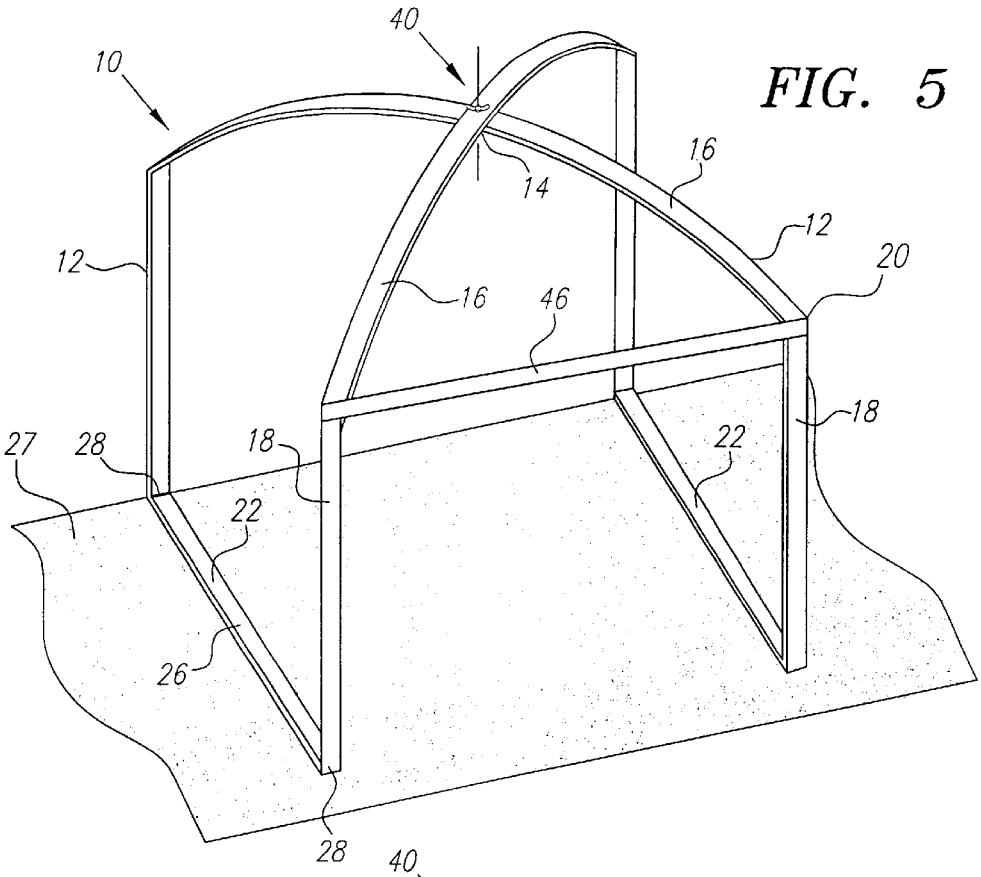
FIG. 5 is a perspective view of another frame.

A further embodiment is illustrated in FIG. 5 which replaces the arch transitions 24 with abrupt angles 28. These angles 28 create a clearer definition between the wall sections and the floor. Added interior room is gained as the effective footprint of the erected structure is increased. The stability of the structure is also increased with such placement of the abrupt angles 28. These angles 28 also affect the collapsible nature of the structure. Storing the structure by collapsing the frame into coils is discussed below. It is appropriate to note here that the angles 28 contribute to a response in storing the structure which makes it harder to begin the process of collapsing the frame but makes it easier beyond a certain point, somewhat similar to an over-center response.

Sheet material 29 extends across at least the interiors of the loops of the arched figure eight frame 10. The material 29 may further extend between loops to a distance outwardly of the cross-over point 14. Indeed, the entire periphery may be enclosed to define a tent or a cover. A beach cabana would appropriately have three sides, 30, 32 and 34, two being interior to the frame 10 to either side of the cross-over point 14 and one being outwardly of the cross-over point 14 and spanning between the loops. The fourth side may be open, partially walled at the top or with some form of flap. With the sheet material 29 in place, a pitched roof 36 is defined on the roof support 16 while the walls are defined between the wall sections 18.

Figure 3:
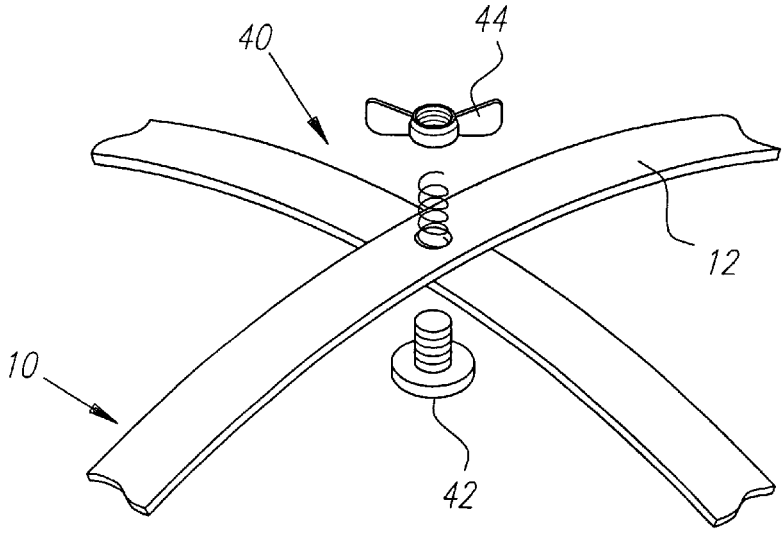
FIG. 3 is a perspective view of an adjustable retainer.
Figure 4:
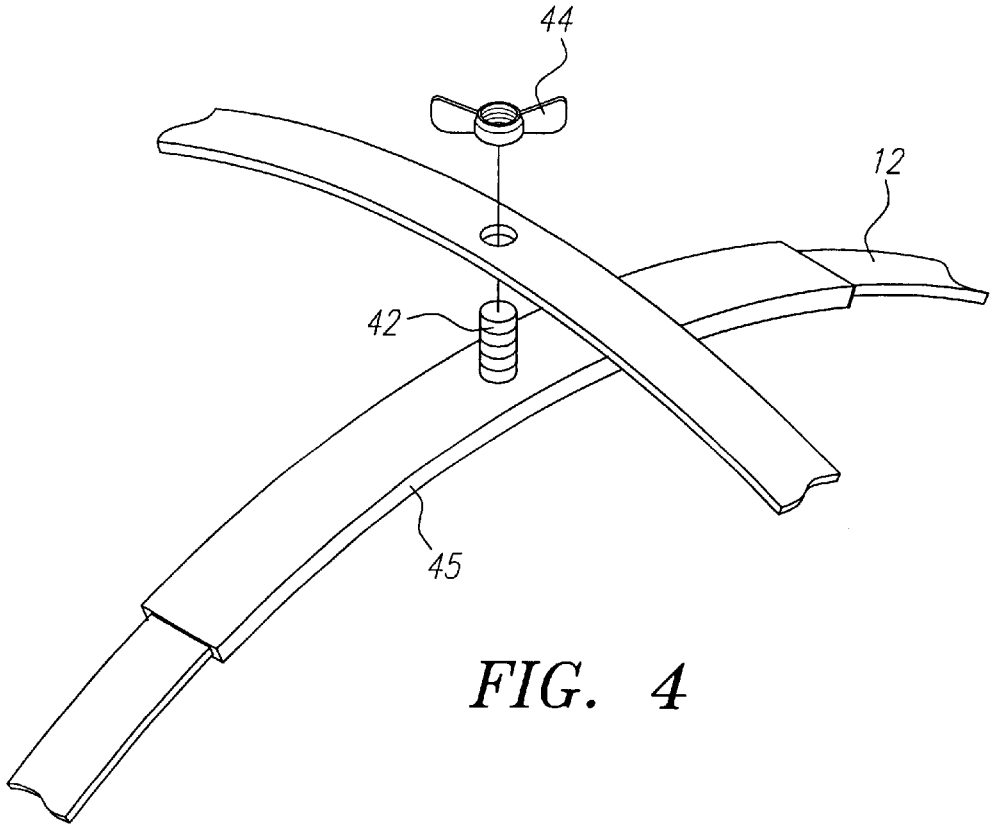
FIG. 4 is a perspective view of another adjustable retainer.

Means for retaining the band at the two opposed positions of the figure eight with the two opposed positions fixed together and the local longitudinal directions of the band at the two opposed positions being fixed at an angle to one another is provided by any one of a variety of retainers, generally designated 40. The retainer 40 is located at the cross-over point 14. The retainer 40 is preferably able to alternately lock and release the band at the opposed positions at the cross-over point. The retainer is illustrated as a bolt 42 and a wing nut 44 in FIG. 3. The bolt extends through holes drilled in the opposed positions at the cross-over point 14 and thereby acts as a pin and has threads to accommodate the nut for fixing the opposed positions of the band at the cross-over point. The bolt may instead be fixed to one of the portions of the frame. A connector 45 is shown carrying the bolt 42 in the embodiment of FIG. 4. The connector is used to tie the ends of the strap together to form the frame. The retainer 40 may be tightened until sufficient friction or interference is experienced so that the portions of the frame 10 extending across the cross-over point 14 are fixed relative to one another. This defines a fixed position for the retainer 40.

By preventing relative movement between the opposed elements at the cross-over point 14, substantially increased rigidity is achieved in the overall structure. With the retainer loosened, a release position is defined where the opposed positions on the frame 10 at the cross-over point 14 are able to rotate relative to one another about an axis extending through the two opposed positions. This allows for collapse of the configuration into six coils.

The structure may further include one or more braces 46 extending between portions of the frame. Any such brace may be rigid and fixed at both ends to the frame displaced from the cross-over point 14. The brace 46 shown in FIG. 5 creates a triangle structure with the roof sections. As such, a rigid structure is presented if the portions of the frame 10 at the cross-over are pinned. The brace 46 may hold the frame in an open condition in a configuration similar to that of the retainer 40. Additional strength is added as well. The brace 46 is preferably removable and may also be flexible. The ability to remove the brace 46 allows the structure to be stored in a collapsed state. If the brace 46 is as flexible as the figure eight frame strap, it would be possible to bend the brace 46 to conform to the shape of the collapsed structure as well.

In operation, such a structure may be stored in a pouch provided therefor in the collapsed state defining six coils. The sheet material 29 simply is drawn with the coils into that configuration. At this point, the retainer 40 is preferably loose so that the portions of the frame 10 can rotate relative to one another. When the structure is brought out and released, the spring nature of the frame 10 causes the structure to open fully. At this point it may rest upon a support surface 27 with the arch transitions 24 supporting the weight of the structure. The retainer 40 may then be placed in the fixed position. The frame may be manipulated prior to achieving the fully clamped state to create the desired effect. A brace, or braces 46 may be added as well.

Figure 6:
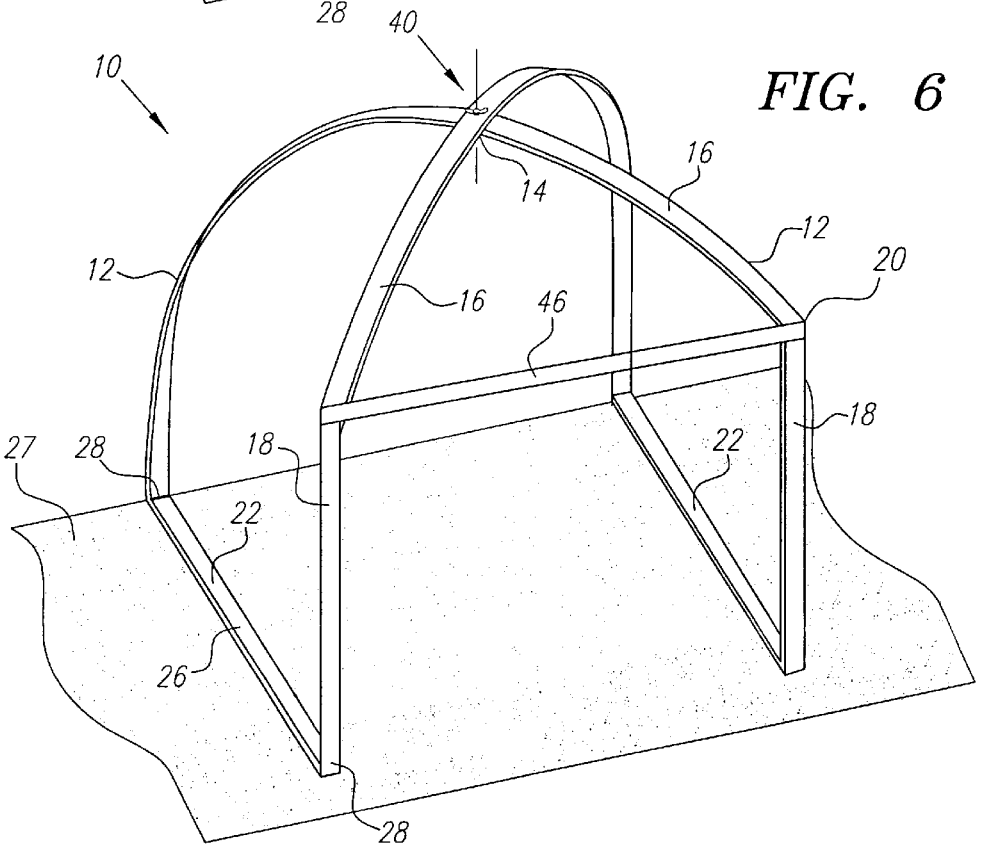
FIG. 6 is a perspective view of another frame.

In the further embodiment of FIG. 6, only two abrupt angles 20, created by permanent deformation, are used on two uprights. These angles 20 are placed on one side of the structure on different loops of the figure eight. This provides for easier access to the structure or frames an opening for a target or the like while not requiring as big an overall structure. When coiled up, the abrupt angles tend to lie together and only protrude from the circle at one position.

Figure 7:
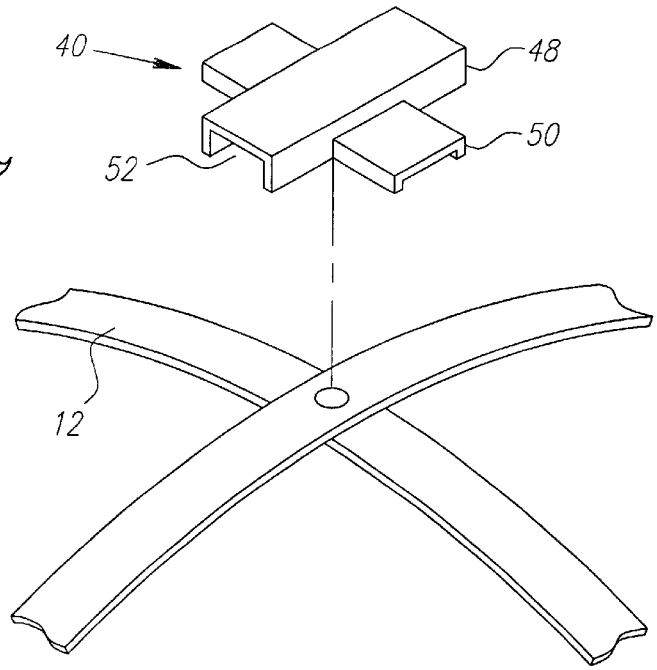
FIG. 7 is a perspective view of another retainer.

In the further embodiment of FIG. 7, a clamp 48 is illustrated which is a rigid structure with two channels 50 and 52 crossing one another. The channels 50 and 52 are arranged at an angle to one another, shown to be 90° in this embodiment, to receive the opposed positions of the strap 12 such that the local longitudinal directions of the band at the two opposed positions are fixed at the same angle to one another. The channels 50 and 52 may be sized to provide a press fit with the strap 12 so as to be retained in position. A bolt or other fastening structure is also contemplated to retain the clamp 48 in position. With the clamp 48, the pin 42 may be considered optional. Yet, it can simplify erection. With the structure collapsed, the channel 52 may receive both opposed positions of the strap 12.

Figure 8:
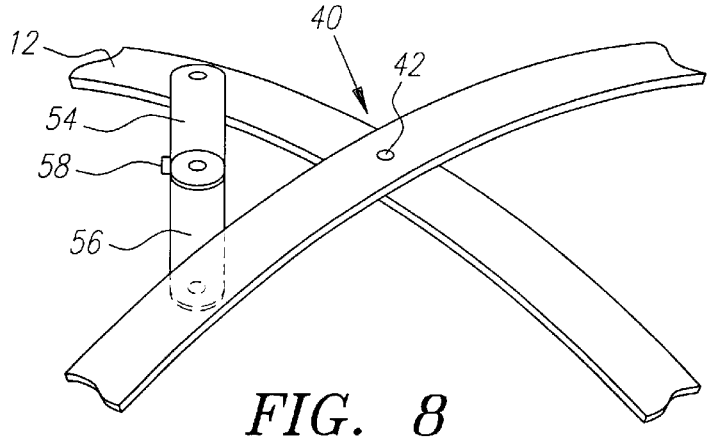
FIG. 8 is a perspective view of another retainer.

In the embodiment of FIG. 8, a retainer 40 is defined by the pin 42 and two links 54 and 56. The pin 42 is at the opposed positions of the band at the crossover. The two links 54 and 56 are pivotally attached to the band at adjacent upright sections of the band. The two links 54 and 56 include an over-center stop 58 on one of the links. The stop 58 allows the two links 54 and 56 to pass beyond alignment so that energy must be put into the compressed links before they pass through alignment and can collapse. Once partially collapsed, the links 54 and 56 allow release of the upright sections so that the band can collapse.

Figure 9:
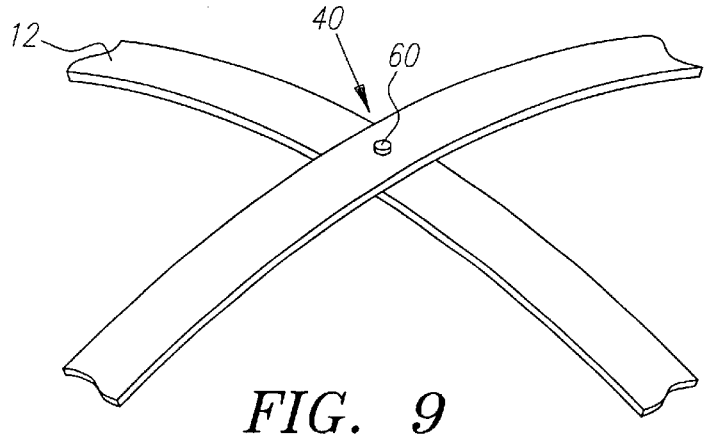
FIG. 9 is a perspective view of another retainer.

In the embodiment of FIG. 9, a rivet 60, or friction pin, is employed as the retainer. A friction element may or may not be included between the opposed positions of the band at the cross-over point. The rivet 60 retains the opposed positions in compression at all times to retain the components in fixed orientation. However, the strap 12 can be manipulated by force against the resistance of the rivet for collapse of the structure.

Figure 10:
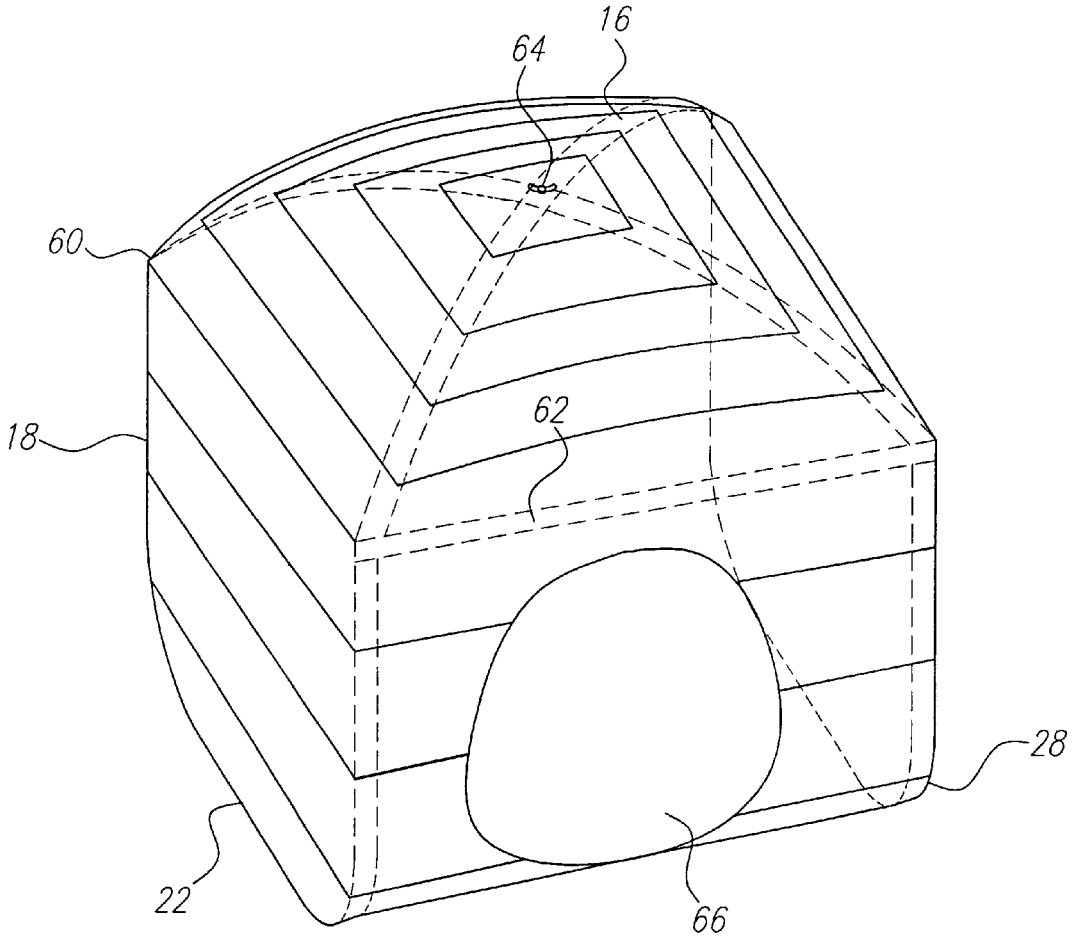
FIG. 10 is a perspective view of another frame.

A further embodiment is illustrated in FIG. 10. The foot sections 22 include abrupt angles 28. The four upright sections all include roof sections 16 and wall sections 18 divided by abrupt angles which each approach a right angle. A retainer 40 includes a pin 64 and braces 62 extending between loops of the figure eight frame. The braces 62 are affixed at the abrupt angle 60 to either side of each of the loops. The braces 62 may be rigid or may include links with an overcenter stop as illustrated in FIG. 8. A cover of sheet material is shown in phantom and includes a door hole 66. A cube is thus formed by this construction. Through either removal of the braces 62 if rigid or collapse thereof if links, the cube can be collapsed as with the other embodiments.

Figure 12:
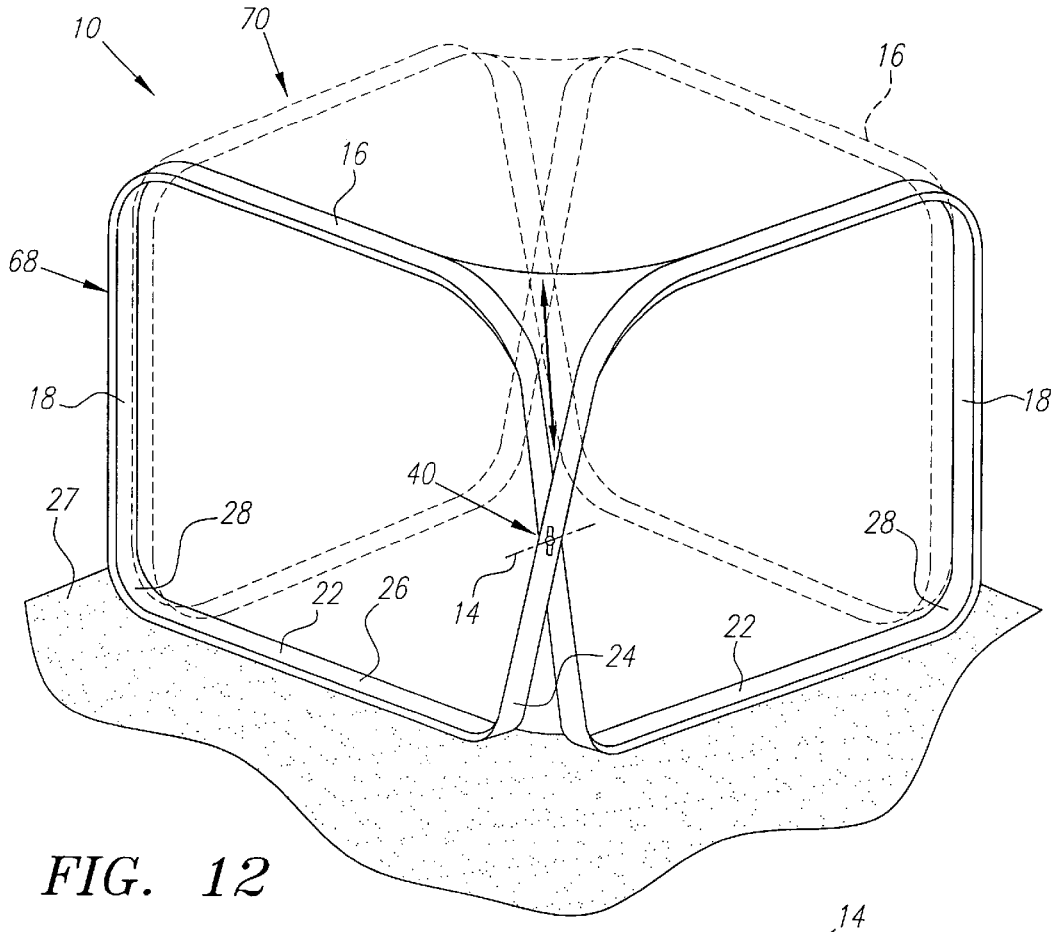
FIG. 12 is a perspective view of another frame.

A further embodiment is illustrated in FIG. 12. The frame 10 consists of two arched figure eight frames 68 and 70. The arched figure eight frames are placed horizontally, so that the bottoms of the figure eights form two wall sections 18, and portions of the sides of the figure eights form the roof sections 16, the foot sections 22 and two other of the wall sections 18. The foot portions may be understood as including an arch transition 24 at the cross-over point end of an elongate section 26. Angles 28 are at the other end of elongate sections 26. These angles 28, and indeed all angles of the device, may be abrupt as illustrated in certain of the figures or sharply curved but continuous as in other of the figures of the disclosure. The elongate section 26 may be sufficiently flat, weak or even slightly inwardly arched such that it does not assume a convex curvature which would act as a rocker to destabilize the overall structure when resting on a support surface 27.

A retainer 40 is located at the cross-over point 14. The retainer 40 is preferably able to alternately lock and release the band at the opposed positions of the cross-over point.

The structure may further include a locking mechanism for connecting the figure eight frame 68 to the figure eight frame 70. One possible locking mechanism has opposing wall sections 18 including strips of hook and loop material.

Figure 13:
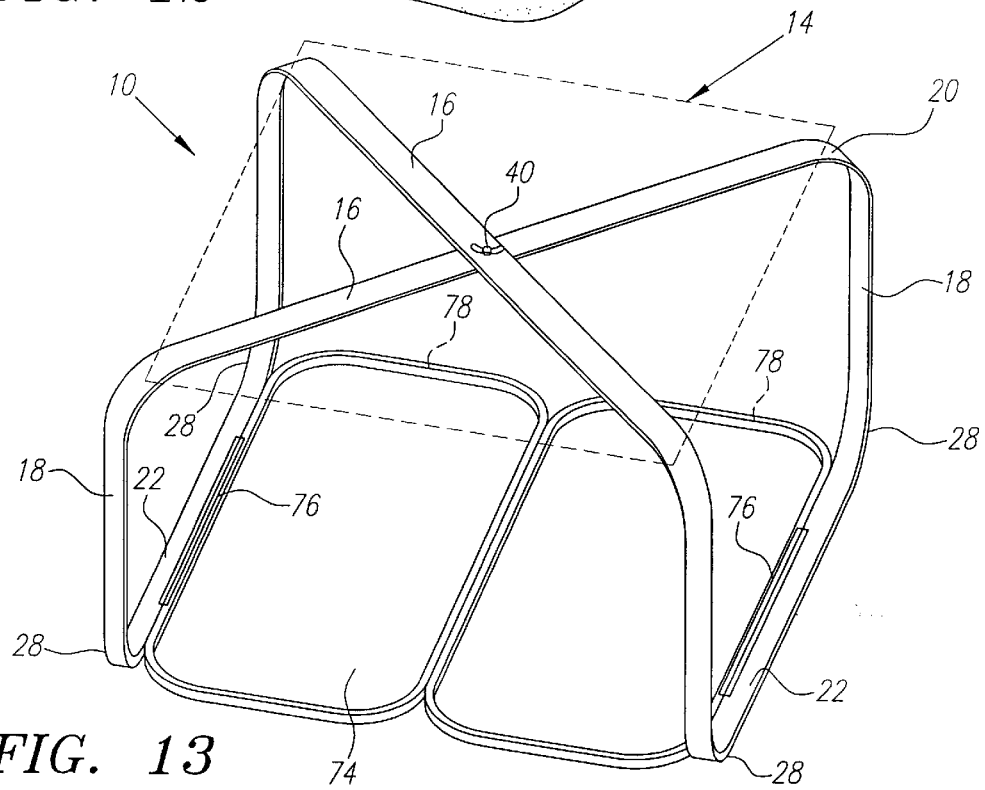
FIG. 13 is a perspective view of another frame.
Figure 15:
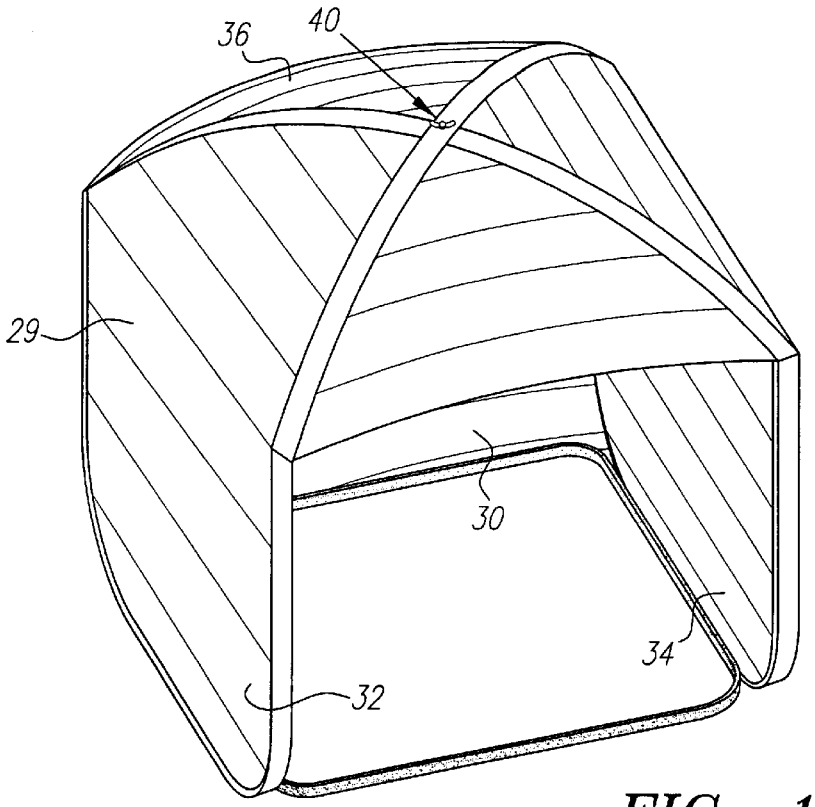
FIG. 15 is a perspective view of another frame.

Further embodiments are illustrated in FIGS. 13 and 15. The frame 10 is a resilient endless band arranged in the shape of a cubed or arched figure eight. Four wall sections 18 extend downwardly from the ends of the four roof sections 16. The four wall sections 18 are parallel to one another in these embodiments. The roof sections meet at crossover point 14. A retainer 40 is used to retain the band at the two opposed positions of the figure eight with the two opposed positions fixed together and the local longitudinal directions of the band at the two opposed positions being fixed at an angle to one another. A typical retainer used is the pin/nut configuration in FIG. 3, consisting of a bolt 42 and a wing nut 44. Two foot sections 22 extend from pairs of the wall sections 18. The foot sections 22 and roof sections 16 connect to the wall sections 18 at angles 28 and 20, respectively, which may be abrupt or tightly but continuously rounded through permanent deformation, both being as illustrated in the several embodiments.

Figure 16:
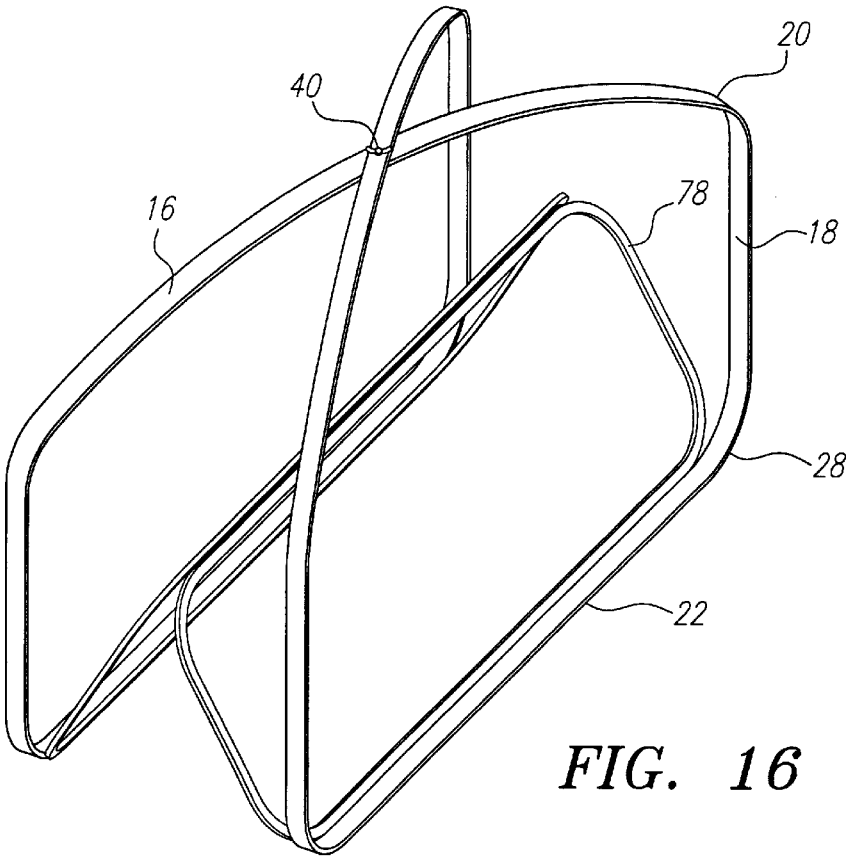
FIG. 16 is a perspective view of the structure of FIG. 13 partially collapsed.

The structure further includes a floor piece 74, which may be made of sheet material, and further consists of one or more rings 78. In FIGS. 13 and 16, there are two rings 78 while in FIG. 15 there is one. The floor piece 74 is held in place to one foot section 22 with hinges 76. These hinges 76 may be made from the covering material or separately constructed of plastic flexible material or even separate pieces fastened together, such as by hook and loop material, ties, zippers and the like. The floor piece 74 is attached to the other foot section 22 depending on the folding requirements of the structure. Both sides and the middle of the floor piece 74 may be hinged without possibility of separation when constructed as in FIGS. 13 and 16. In the case of FIG. 15, only one side of the floor piece 74 may be conveniently permanently attached. Of course, it too may be detachable. The side of the floor piece 74 meeting with the other foot section 22 may be detachable using hook and loop material in the embodiment of FIG. 15. Detaching the floor piece 74 by pulling apart the hook and loop material allows the floor piece 74 of FIG. 15 to be brought into the plane of one side of the structure first, so that the entire frame 10 may be folded. The collapse of the structure in FIG. 13 is as presented in FIG. 16. To ensure proper folding in either embodiment, each floor piece ring 78 should have a size approximate to a side of the cube formed by two parallel wall sections 18 and a connecting foot section 22. For example, the two floor piece rings 78 of FIGS. 13 and 16 contemplate that the floor is twice the approximate size of a wall defined by any one loop. A retainer 40 may be used in either of the embodiments of FIG. 13 and 15. However, such a retainer 40 is now, to a partial extent, redundant as the floor provides rigidity to the structure.

Figure 14:
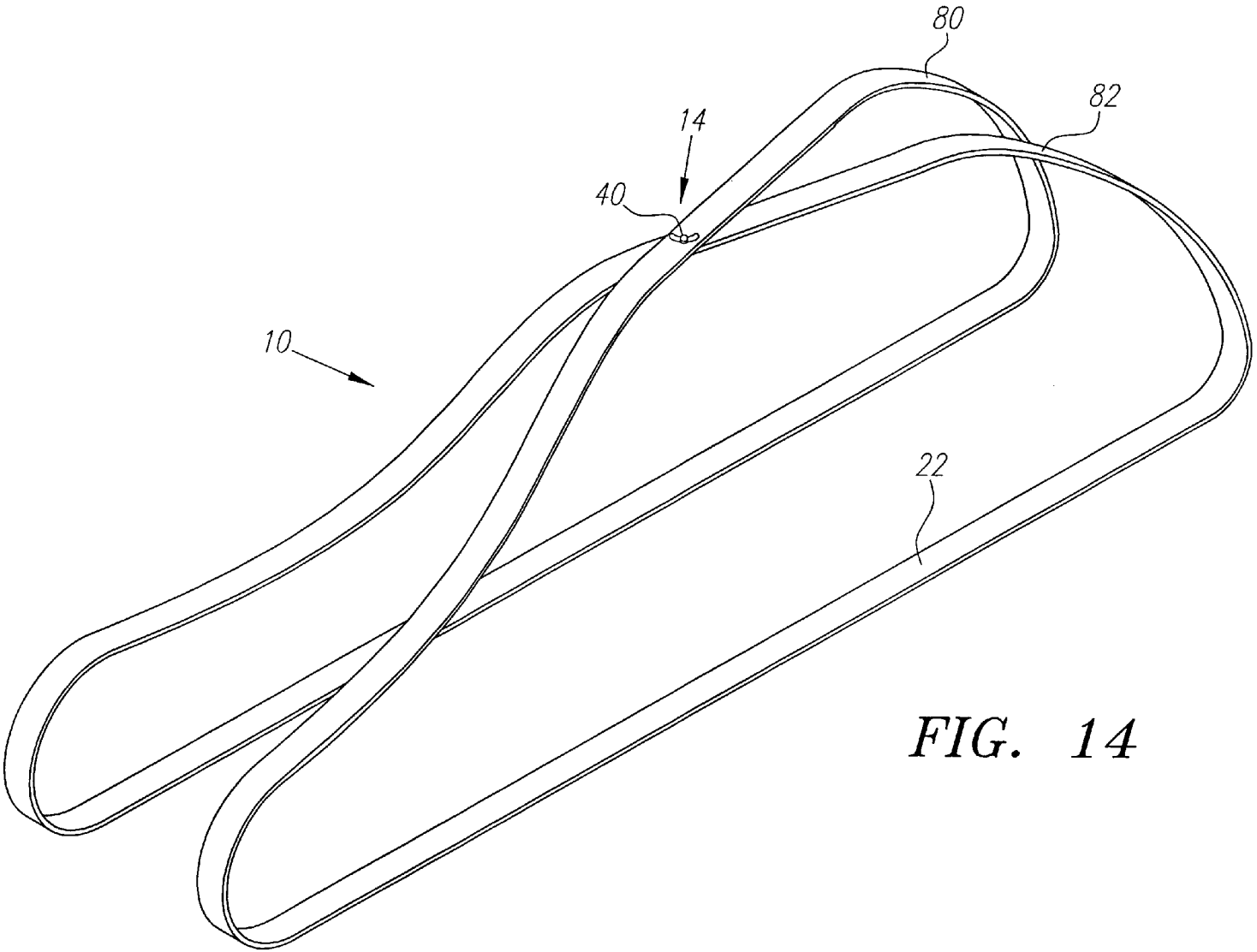
FIG. 14 is a perspective view of another frame.

A further embodiment is illustrated in FIG. 14. The frame 10 is shaped so that there are loops 80 and 82 of appropriate length and configuration through permanent deformation to approximate the shape of a recognizable object. The roof sections meet at the cross-over point 14. A retainer 40 is used to retain the band at the two opposed positions of the figure eight with the two opposed positions fixed together and the local longitudinal directions of the band at the two opposed positions being fixed at an angle to one another. A typical retainer used is the pin/nut configuration in FIG. 3, consisting of a bolt 42 and a wing nut 44. The loops are asymmetrical and the cross-over point 14 is not necessarily at the apex. The shape approximates a car in this embodiment and may exhibit printed indicia, separate material or laminar components to approximate features of the car such as windows and wheels.

Figure 17:
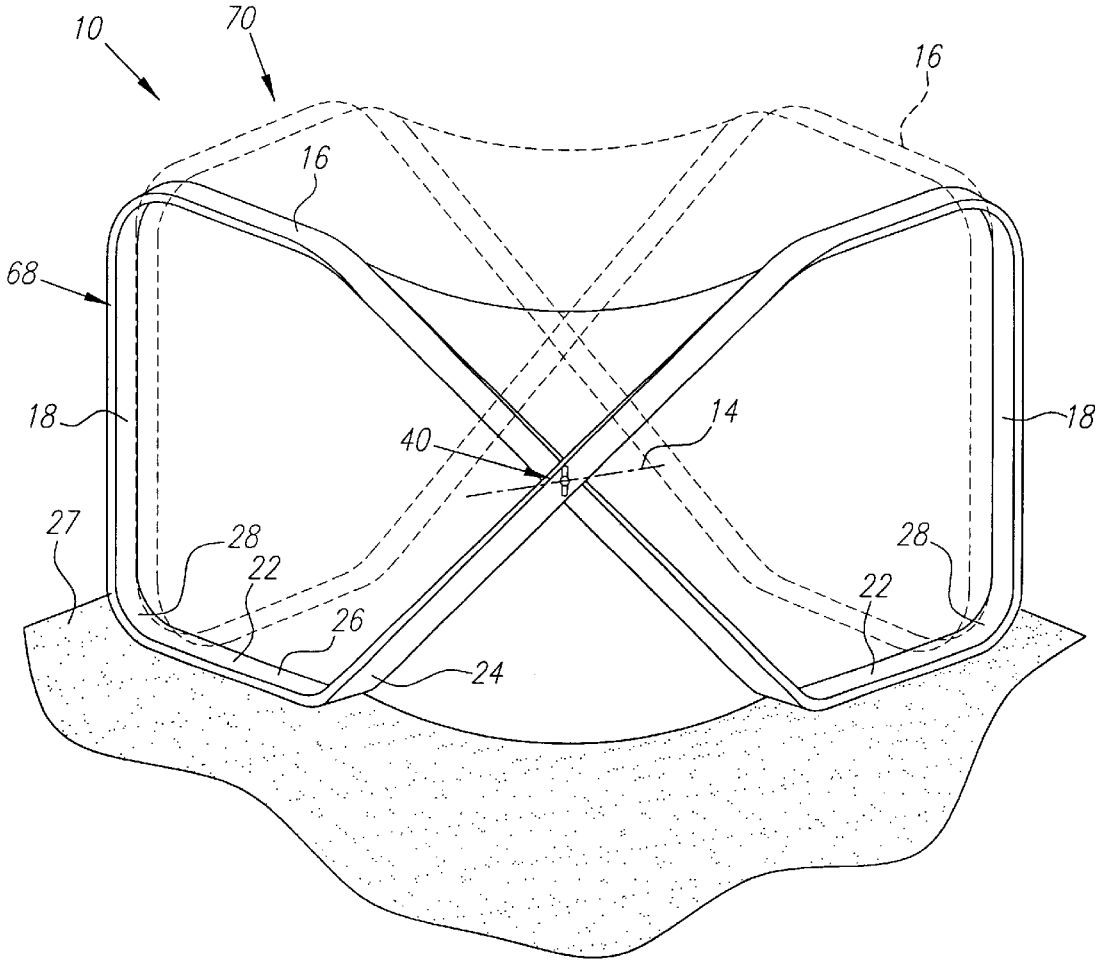
FIG. 17 is a perspective view of another frame.

A further embodiment is illustrated in FIG. 17. It is constructed much as FIG. 12. However, a hexagonal figure is created. The two arched figure eight frames 68 and 70 are placed and configured much as in FIG. 12. The cross-over point 14 is configured to have the elements closer to right angles than overlaying one another. Thus, each cross-over area becomes another side.

Thus, improved portable structures with greater stability and improved form are disclosed. While embodiments and applications of this invention have been disclosed, it would be apparent to those skilled in the art that many more modifications are possible without departing from the inventive concepts herein. The invention, therefore is not to be restricted except in the spirit of the appended claims.

What is claimed is:

1. A structure comprising a frame formed of a flexible endless band in the shape of an arched figure eight, the band including four upright sections, at least two of the upright sections each including a roof section extending a first length from the cross-over point and a wall section extending a second length from the roof section, and two foot sections each extending between two of the upright sections, respectively, the band having a permanent deformation to redirect the band at each position between the roof sections and the wall sections;

sheet material extending at least across a portion of each of the loops of the figure eight frame.

2. The structure of claim 1, each of the two foot sections extending from a wall section.

3. The structure of claim 1, the two foot sections each having a permanent deformation to redirect the band at either end and an elongate section therebetween which separates the two permanent deformations, the four permanent deformations supporting substantially all the weight of the frame when placed on a supporting surface.

4. The structure of claim 1, the sheet material extending between adjacent roof sections to form a pitched roof.

5. The structure of claim 1, the four upright sections each including a roof section extending the first length from the cross-over point and a wall section extending the second length from the roof section, the permanent deformations being abrupt angles at each position between the roof sections and the wall sections.

6. The structure of claim 5, the sheet material extending between adjacent roof sections to form a pitched roof.

7. The structure of claim 1, the sheet material extending between adjacent roof sections to form a flat roof.

8. The structure of claim 7, the sheet material extending between at least three adjacent wall sections.

9. The structure of claim 1, the sheet material extending between at least three adjacent wall sections.

10. The structure of claim 9, the wall sections being substantially parallel.

11. The structure of claim 1, the wall sections being substantially parallel.

12. The structure of claim 1, the resilient endless band being collapsible into a configuration with six overlying coils with the sheet material remaining thereon.

13. A structure comprising a frame formed of a flexible endless band in the shape of an arched figure eight, the band including four upright sections, at least two of the upright sections each including a roof section extending a first length from the cross-over point and a wall section extending a second length from the roof section, and two foot sections each extending between two of the upright sections, respectively, the band having a permanent deformation to redirect the band at each position between the roof sections and the wall sections;

sheet material extending at least across a portion of each of the loops of the figure eight frame;

a retainer attachable to the endless band at the two opposed positions at the cross-over point in the figure eight frame, the retainer including a fixed position retaining the band at the two opposed positions with the two opposed positions fixed together and the local longitudinal directions of the band at the two opposed positions being fixed at an angle to one another.

14. The structure of claim 13, the retainer further including a release position retaining the band at the two opposed positions rotatable relative to one another about an axis extending through the two opposed positions.

15. The structure of claim 14, the resilient endless band being collapsible into a configuration with six overlying coils with the sheet material remaining thereon with the retainer in the release position.

16. The structure of claim 13, the two foot sections each having an arc transition at either end and an elongate section therebetween which separates the two arc transitions, the four arc transitions supporting substantially all the weight of the frame when placed on a supporting surface.

17. The structure of claim 13, the two foot sections each having an elongate section and two abrupt angles at either end of the elongate section and joined with the wall sections, respectively, the sheet material extending between adjacent roof sections to form a flat roof.

18. The structure of claim 17, the retainer including a pin through the band at the two opposed positions and braces extending between opposite permanent deformations between the roof sections and the wall sections, respectively.

19. The structure of claim 13, the permanent deformations between the roof sections and the wall sections, respectively, being abrupt angles.

20. A structure comprising a frame formed of a flexible endless band in the shape of an arched figure eight, the band including four roof sections extending a first length from the cross-over point, four wall sections extending a second length from the four roof sections, respectively, and two foot sections each extending between two of the wall sections, respectively, the band having a permanent deformation at each position between the four roof sections and the four wall sections, respectively, the two foot sections each having an arc transition at either end and an elongate section therebetween which separates the two arc transitions, the four arc transitions supporting substantially all the weight of the frame when placed on a supporting surface;

sheet material extending at least across a portion of each of the loops of the figure eight frame, the sheet material extending between adjacent roof sections to form a roof and extending between at least three adjacent wall sections;

a retainer attachable to the endless band at the two opposed positions at the cross-over point in the figure eight frame, the retainer including a fixed position retaining the band at the two opposed positions with the two opposed positions fixed together and the local longitudinal directions of the band at the two opposed positions being fixed at an angle to one another and a release position retaining the band at the two opposed positions rotatable relative to one another about an axis extending through the two opposed positions.

21. The structure of claim 20, the permanent deformations between the roof sections and the wall sections, respectively, being abrupt angles.

22. A structure comprising a frame formed of two resilient endless bands, each in the shape of an arched figure eight, each band including two upright sections at diagonally opposing ends of the frame, and each including two roof sections extending a first length between the upright sections and the cross-over points, and two foot sections each extending a first length between the upright sections and the cross-over points;

sheet material extending at least across a portion of each of the loops of each figure eight frame;

two retainers attachable to each endless band at the two opposed positions at the cross-over point in each figure eight frame, the retainers including a fixed position retaining the bands at the two opposed positions with the two opposed positions fixed together and the local longitudinal directions of the bands at the two opposed positions being fixed at an angle to one another.

23. The structure of claim 22, the retainers further including a release position retaining each band at the two opposed positions rotatable relative to one another about an axis extending through the two opposed positions.

24. The structure of claim 23, each resilient endless band being collapsible into a configuration with six overlying coils.

25. The structure of claim 22, the two foot sections of each band each having an elongate section and an abrupt angle at the upright end of the elongate section and joined with the wall sections, respectively, the sheet metal extending between adjacent roof sections to form a flat roof.

26. The structure of claim 22, two endless bands further including a mechanism for locking the bands together.

27. The structure of claim 26, the locking mechanism being looped material.

28. A structure comprising a frame formed of a resilient endless band in the shape of a cubed, arched figure eight, the band including four upright sections, each including a roof section at a permanent deformation to the upright section, and two foot sections each extending between two of the upright sections, respectively, the band having a permanent deformation at each position between the upright sections and foot sections;

sheet material extending at least across a portion of each of the loops of the figure eight frame;

a floor piece attachable to the endless band at each foot section, where the floor piece is the same size as a side panel, and where the floor piece is formed by two rings;

a retainer attachable to the endless band at the two opposed positions at the cross-over point in the figure eight frame, the retainer including a fixed position retaining the band at the two opposed positions with the two opposed positions fixed together and the local longitudinal directions of the band at the two opposed positions being fixed at an angle to one another.

29. The structure of claim 28, the retainer further including a release position retaining the band at the two opposed positions rotatable relative to one another about an axis extending through the two opposed positions.

30. The structure of claim 29, the resilient endless band being collapsible into a configuration with six overlying coils with the sheet material remaining thereon with the retainer in the release position.

31. The structure of claim 29, the retainer including a pin through the band at the two opposed positions.

32. The structure of claim 31, the pin having threads and the retainer further including a nut to clamp the band together at the two positions.

33. The structure of claim 28, the floor piece being attached to one foot section with hinges.

34. The structure of claim 33, the floor piece being attached to the non-hinged foot section with hook and loop material.

35. The structure of claim 34, the floor piece being collapsible into a configuration that can be folded with the resilient endless band.

* * * * *